US006988618B2

(12) United States Patent
DeJonge

(10) Patent No.: US 6,988,618 B2
(45) Date of Patent: Jan. 24, 2006

(54) CHILD RESISTANT BLISTER PACK DISPENSER WITH LOCKING SIDE TABS

(75) Inventor: Stuart W. DeJonge, Lake Ariel, PA (US)

(73) Assignee: DeJonge Associates, Inc., Lake Ariel, PA (US)

( * ) Notice: Subject to any disclaimer, the term of this patent is extended or adjusted under 35 U.S.C. 154(b) by 176 days.

(21) Appl. No.: 10/764,789

(22) Filed: Jan. 26, 2004

(65) Prior Publication Data

US 2005/0161364 A1 Jul. 28, 2005

(51) Int. Cl.
*B65D 83/04* (2006.01)

(52) U.S. Cl. ..... 206/528; 206/1.5; 206/539

(58) Field of Classification Search ..... 206/1.5, 206/528, 530, 531, 532, 534, 535, 538, 539, 206/540, 807; 220/345.1, 345.3; 221/25, 221/26, 87, 92, 124, 131

See application file for complete search history.

(56) References Cited

U.S. PATENT DOCUMENTS 1,994,063 A * 3/1935 Bruns et al. ..... 206/528
3,888,350 A 6/1975 Horvath
3,942,630 A 3/1976 Phillips
3,993,190 A 11/1976 Schmidgall
4,159,568 A 7/1979 Berner
4,284,204 A 8/1981 Casey, Jr.
4,485,915 A 12/1984 Berghahn
4,561,544 A 12/1985 Reeve
4,844,284 A 7/1989 Drozd et al.
5,019,125 A 5/1991 Rebne et al.
5,082,137 A 1/1992 Weinstein
5,109,984 A 5/1992 Romick
5,251,757 A * 10/1993 Relyea et al. ..... 206/531
5,339,960 A 8/1994 Price
5,437,371 A 8/1995 Lataix
5,575,399 A 11/1996 Intini
5,878,887 A 3/1999 Parker et al.
6,036,018 A 3/2000 Harrold
6,460,693 B1 10/2002 Harrold
6,854,618 B2 * 2/2005 Harrold ..... 206/531
6,863,175 B2 * 3/2005 Gelardi ..... 206/1.5

* cited by examiner

*Primary Examiner*—Luan K. Bui
(74) *Attorney, Agent, or Firm*—Kenneth P. Glynn

(57) ABSTRACT

The child resistant multiple dosage blister pack dispenser includes a main housing bottom component for supporting and securing a blister pack. The bottom component has a first spring lock member for interaction with a second spring lock member located on a top component. One of the first and second spring lock members has a rest position, being a top component locking position to prevent tablet dispensing sliding movement of the top component, and a stressed position, being a top component unlocking position to permit sliding movement of the top component. The bottom component has a plurality of ones of either male or female or both male and female tab lock elements, forming lock sets with its counterpart, each lock set having a different opening position from all other lock sets. The main housing top component is slideably mounted on the bottom component with a plurality of tabs, each having a male or female lock element corresponding to the ones on the bottom component. The tabs have pull-up capability, such that when the spring lock member is in the stressed position and the top component has been moved forward, a first tab may be removed and one dosage unit exposed for removal. The steps are repeated to access each additional dosage.

20 Claims, 5 Drawing Sheets

CHILD RESISTANT BLISTER PACK DISPENSER WITH LOCKING SIDE TABS

BACKGROUND OF THE INVENTION

1. Field of the Invention

The present invention relates to a unique solution to protecting multiple dosage blister packs from children, while affording appropriate users a convenient mechanism for storing and dispensing blister pack doses. The invention is a dispenser in which a multiple dosage blister pack is stored, whereby it is locked into the dispenser to isolate and encompass it, thereby disabling it from puncture or content (tablet or medication) removal. A user must first push down on a spring lock, then slide a top to a firing position and press an advanced tab to release a dosage. As soon as the user releases the top relative to the bottom, the spring recovers and locks, the device returns to the secured, child resistant, locked position. Each tab has a unique lock. And the device can only be operated one tab at a time, sequentially, by releasing the spring lock to re-lock the device, and repeating the sequences to unlock.

2. Information Disclosure Statement

The following United States patents are exemplary of the state of the art for blister packs and child resistant blister packs:

U.S. Pat. No. 3,888,350 describes a snap lock and squeeze open slide top container that has a small centered catch depending from the inner face of the cover. The edge of the catch forms with the closed end of the cover a slot which accommodates the rear edge of the drawer portion of the container. The profile of the catch is tapered, forming an inclined plane directed to the front end of the container. The cover and drawer are slidably engaged by lateral meshing flanges which are interrupted near the closed end to provide slight clearances between the inside of the cover and the outside of the drawer. These clearances, together with an inverted V-shaped cut centered in the rear skirt of the cover, permit the cover to bow up when the sides are squeezed, releasing the edge of the drawer portion from the slot formed by the catch, to open the drawer. When the drawer is closed, the edge portion rides forward along the inclined plane depending from the cover, engaging the slot with a click, to lock the container closed. To prevent spillage, the opening of the drawer is limited by a pair of small stops depending from the inner face of the cover near each side wall, which ride in elongated recesses in the lateral walls.

U.S. Pat. No. 3,942,630 describes a sliding cover safety package including a container having a cover mounted thereon for slidable movement between open and closed positions with respect to the container. The container and cover are provided with locking lugs having a locked position when the cover is closed in which the cover is locked against movement from its closed position with respect to the container, and an unlocked position when the cover is closed in which the cover can slide with respect to the container to its open position. The locking lugs are movable between the locked and unlocked positions by axial movement of the cover with respect to the container. Resilient biasing members is engaged between the container and cover to bias the locking lugs to the locked position such that the cover can slide from its closed position with respect to the container only after axial movement of the cover with respect to the container against the biasing members.

U.S. Pat. No. 3,993,190 describes a method and apparatus for packaging and dispensing stain removing agents in small, individual capsules. The stain removing agents are preferably in paste form. The individual capsules are readily deformable and are stored in individual troughs in a receiving plate which, in turn, is covered by a covering sheet.

U.S. Pat. No. 4,159,568 describes a container for capsules and the like having a cutter associated with the container for cutting the capsules. Hinged upper and lower portions of the container have cutting members secured thereto. Closure of the container portions effects cutting of a capsule inserted between the cutting members. In the preferred embodiments, the cutting members comprise a trough-shaped notch in the front wall of one of the container portions and a blade secured to the front wall of the other of the container portions, the blade and notch being superposed. An internal compartment is provided to receive a cut portion of a capsule.

U.S. Pat. No. 4,284,204 describes a two-part package that includes a sleeve for receiving a try. One surface of the sleeve has openings formed therein for receiving dimpled detents formed in the tray. As the tray is fully positioned in the sleeve, the detents engage the openings and retain the tray thereby inhibiting unwanted opening of the package and release of contents. Upon exertion of sufficient manual force on the sides of the sleeve, detent action is overcome and the package is opened as desired.

U.S. Pat. No. 4,485,915 describes a child resistant package having an outer container and an inner product supporting tray; the inner tray is adapted to be inserted into the container to a locked position and removed therefrom by disengaging a locking means and withdrawing the tray; the inner tray is disengaged from the container by pressing inwardly a pair of flexible tabs formed at the back end of the side walls of the tray; in a preferred embodiment a blister pack containing tablets is disposed on the product tray and the tray bottom is provided with holes through which the tablets in the blister pack may be pushed.

U.S. Pat. No. 4,561,544 describes a child resistant container for pills and the like that has a try which slidably engages a lid and is locked in a fully closed position as a spring arm on the tray urges a locking detent on the arm into engagement with a locking aperture located in an adjacent side wall of the lid. Manual depression of the detent releases the tray for opening as an exposed front wall thereof is pulled.

U.S. Pat. No. 4,844,284 describes a child resistant package that includes a tray with a compartment therein for receiving articles to be packaged, and a cover member slideably received on the tray and movable relative to the tray between opened and closed positions. The cover member is a flexible member having a top wall and peripheral side walls. The peripheral side walls of the cover member overlie peripheral side walls of the tray and latching members on the side walls of the cover member and tray cooperate to retain the cover member in a closed position relative to the tray. The latching members are released by applying an inward pressure to the top wall of the cover member to thereby bias the side walls of the cover member outwardly relative to the side walls of the tray. An abutment member on the tray prevents such inward deflection of the top wall of the cover member in the event that a child bites down on the package on the forward region thereof. Preferably, a peripheral skirt is provided on the tray for overlying lower marginal surfaces of the peripheral walls of the cover member, to thereby prevent a child from wedging his or her teeth between the peripheral walls of the cover member and tray, and thereafter prying the cover member off the tray.

U.S. Pat. No. 5,019,125 describes a solid medicament dispensing device having a cover and tray to provide a container for a cartridge for the solid medicament. The cover has hinged panel members and the tray an opening in the floor. When the hinged panel members are moved against the cartridge, it forces the medicament out of the cartridge and through the tray opening. The dispensing device is particularly suited for dispensing large dosages of capsules.

U.S. Pat. No. 5,082,137 describes a child resistant locking slide box that is opened by deforming a locking tab on the slide box drawer that positively engages the surrounding cover. There are tracks on the inside surfaces of the cover side walls that positively engage and slide along tracks positioned on the outside surfaces of the drawer side walls. The engagement of the cover and draw tracks allow only for the respective lateral movement of the cover across the drawer. The lateral movement of the cover allowed by the tracks is restricted in one direction by the drawer locking tab.

The drawer locking tab has a step that overlaps the cover surface. To open the slide box the cover tab must first be deformed backward, removing the step from the above cover, and then downward so that the whole locking tab is beneath the cover. Once the draw tab is below the cover, the drawer can be pushed past the cover, exposing the contents of the drawer.

U.S. Pat. No. 5,109,984 describes reusable, plastic medication dispensing containers for dispensing medication from a blister pack. The container includes a top, bottom, and retaining frame the are molded from a one-piece plastic and hingeably connected one to the other.

U.S. Pat. No. 5,878,887 describes a child-resistant blister-package having a tray adapted to receive a blister card with at least one blister compartment is provided. The tray includes a first slide component. A cover having a top and a second slide component is provided. The second slide component is complementary to and slidingly engaged with the first slide component. The second slide component is connected to the top of the cover such that the cover can be slidably displaced relative to the tray between a first position, in which the top of the cover substantially overlies the tray and is adapted to prevent access to the blister card, and a second position, in which the cover is displaced at least partially from the tray such that the blister card is exposed. A tab is connected to the cover, and one of a locking projection and slot is located on the tab. The other of the slot and the locking projection is located on a first portion of the tray in a complementary location to the locking projection when the cover is in the first position, such that the locking projection is engaged in the slot to limit relative movement of the cover with respect to the tray. One of the tab and first portion of the tray is movable to a position in which the locking projection is disengaged from the slot to permit movement of the cover to the second position.

U.S. Pat. No. 6,036,018 describes a child resistant safety container for blister packs with a housing with an opening, and slides located inside the housing which position and retain several drawers inserted into the opening. A latching mechanism is provided to engage and retain each of the drawers when inserted into the housing. The latching mechanism has cooperating male and female parts located on the drawer and the housing in positions complimentary to each other. The part located on the housing is functionally operable with a latching trigger slidably connected to the housing. Resilient living springs are provided to urge each of the drawers into latching engagement and, when a drawer is pushed in against the spring, moves to partially disengage the drawer. The latching trigger moves the latching mechanism into a second position fully disengaging the drawer for removal. The remainder of the drawers which have not been pushed in remain retained in the safety container by the latching means.

Notwithstanding the prior art, the present invention is neither taught nor rendered obvious thereby.

SUMMARY OF THE INVENTION

The present invention is a child resistant multiple dosage blister pack dispenser that may be inexpensively produced, yet will function effectively and efficiently. This present invention dispenser has been created to function with blister packs having at least one, and preferably two rows of medication, with a plurality of medication in each row. The present invention dispenser includes a main housing bottom component for supporting a blister pack, and a main housing top component.

The bottom component has a first spring lock member for interaction with a second spring lock member located on a top component. One of the first spring lock member and the second spring lock member is movable relative to the other. Thus, one of these spring lock members has a first position, being a rest position, wherein it is in a top component locking position to prevent tablet dispensing sliding movement of the top component relative to the bottom component, and has a second position, being a stressed position, wherein it is in a top component unlocking position to permit sliding movement of the top component. This is a first stopping mechanism to prevent or inhibit child intrusion. A second stopping mechanism is the necessity with the present invention device to push the top component to an opening position to disable a lock member on each pull tab, one at a time (sequentially), to permit opening of a tab, and access to medication (a tablet or other medication).

The bottom component has an elongated configuration with a front or back having an opening through which a blister pack may be inserted and secured, individual dosages of the blister pack being located within the bottom component in a predetermined pattern.

The main housing bottom component has a plurality of ones of male and female tab lock elements, that is it may have all male, all female, or at least one of each. The top component will have the opposite (male or female) proximate to it (above it when stressed for opening). Each of the plurality of ones of male and female lock elements corresponding to one another form lock sets, each lock set having a different opening position from all other lock sets.

The main housing top component is permanently and slideably connected to the bottom component. The top component is laterally moveable relative to the bottom component, i.e., it may be pushed or moved relative to the bottom component when one of said first spring lock member and said second spring lock member is in said stressed position. In preferred embodiments, top component movement is only in one direction. The top component has a plurality of tabs located on it, each of the plurality of tabs having one of a male and female lock element opposite to the corresponding one of said plurality of ones of the main housing bottom component. Each of the plurality of tabs has pull-up capability, such that when one of the first and second spring lock members is in the stressed position and the top component has been moved to a predetermined position, a first tab may be opened and one dosage unit is exposed for removal.

There are a plurality of stops that permit only one tab to be opened at a time. Therefore, after the first tab is opened for medication dispensing, sequentially thereafter, only one next tab is opened for one next dosage unit exposure, and so on until all are opened. Because the stops are spaced differently, e.g. in a shifting pattern, and control movement of the top component relative to the bottom component, the second tab cannot be removed or opened until after the first, the third cannot until after the second, and so on. In some preferred embodiments, the tabs act both as tabs and stops. Thus, while they are described separately herein because they have separate functions, they may physically be the same components or different, separate components.

The present invention dispenser main housing top component, in most preferred embodiments, has at least two side walls and a top panel wherein the tabs are located in the top panel. The top component and bottom component may be slideably connected to one another in any known manner.

In some preferred embodiments, the dispenser bottom component includes one of a track and a track rider, and the top component includes walls having the other of the track and track rider. The track rider is located in the track so as that the track rider is slideable therein. In some preferred embodiments, there are two opposite tracks and two corresponding track riders along the walls.

In some preferred embodiments, the dispenser main housing top component and bottom component are rectilinear, but any functional shape may be used. In some of these embodiments, the dispenser top component second position is located in a shifted position from sliding front to back, in others, back to front. Front is preferred.

In some embodiments, the bottom component includes an open area for insertion of a blister pack. For example, there may be an open area in the front with a blister pack stop such that a blister pack may be inserted so as to slide over or ramp over the stop, and it will then be prevented from removal by catching on the stop.

In other embodiments, the blister pack may be sealed inside the dispenser. In those embodiments wherein a blister pack is slid into the dispenser, the bottom component may include a blister pack retainer stop to prevent removal of a blister pack therefrom.

The top component and the bottom component may be made of metal, plastic, cellulosic materials or combinations thereof, and may be formed or made separately. Plastic is preferred and these two components may be formed or molded of the same or different materials.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figures 1, 2, 3:
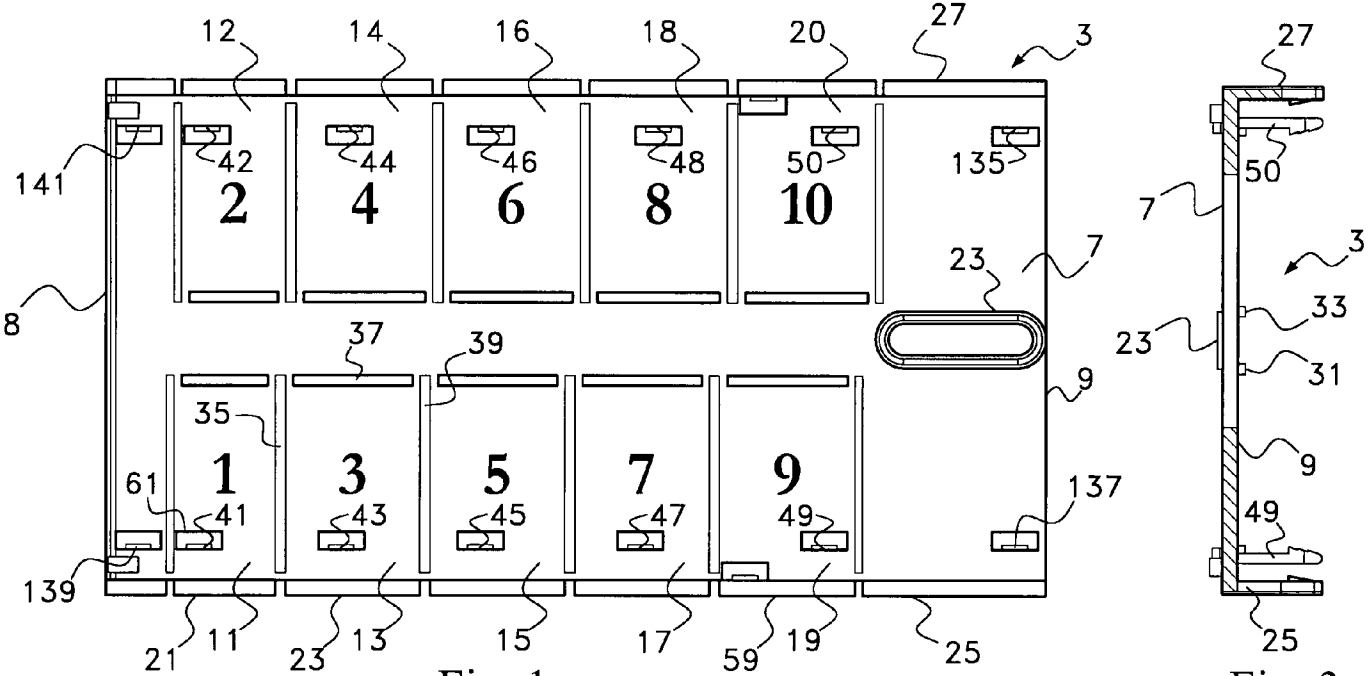
FIG. 1 shows top view.
FIG. 2 shows a side view.
FIG. 3 shows a back end view of one embodiment of the present invention child resistant multiple dosage blister pack dispenser main housing top component.

In order to better understand the present invention dispenser, reference is first made to FIGS. 1 through 6, illustrating the present invention mail housing top component and bottom component:

FIG. 1 shows a top view of a preferred embodiment of the present invention child resistant multiple dosage blister pack dispenser a main housing top component 3, one of the two primary components of the present invention device. Top component 3 includes a top panel 7, a first side wall 25 and a second side wall 27. It has a plurality of tabs that are individually openable when specified movements occur. These tabs must be opened sequentially and are shown as tabs 11, 12, 13, 14, 15, 16, 17, 18, 19, and 20. They have side walls such as side walls 21 and 23. There are also thin areas surrounding the tabs on their tops, such as thins 35, 37 and 39 surrounding tab 13. This permits lift and tear movement when the device is in an appropriate opening position in accordance with the details set forth below.

Each tab has a cut-out or window, such as window 61 of tab 11. As can be seen in window 61 of tab 11, there is a male lock element protrusion 41. Reviewing each tab 11, 12, 13, 14, 15, 16, 17, 18, 19, and 20 sequentially reveals male lock element protrusions 41, 42, 43, 44, 45, 46, 47, 48, 49 and 50, respectively. Note that each such male lock element protrusion is positioned differently relative to their sides of its respective tab. This creates a unique sequential unlocking position for each tab.

Front end 8 of top component 3 will be the advancing edge in this embodiment when connected to the main housing bottom component described below. Elongated orifice 23 located near back 9 of top panel 7 is adapted to receive a spring lock member from the main housing bottom component that interacts with a plurality of ratchetes such as ratchetes 31 and 33 (FIG. 3), that, in conjunction with other components, control movement of top component 3 relative to bottom component 5 described in conjunction with FIGS. 4, 5 and 6 below.

FIGS. 2 and 3 show side and back end views, respectively, of top component 3 shown in FIG. 1 and identical parts are identically numbered.

Figure 6:
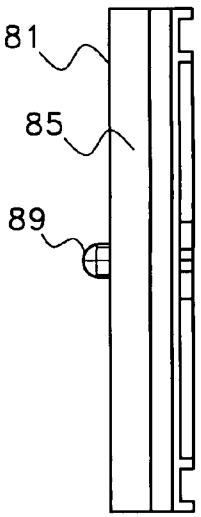
FIGS. 4, 5, and 6 show a top view, a side view and back end view of a main housing bottom component of the present invention device for use in conjunction with the top component shown in FIGS. 1, 2, and 3 above.
Figure 4:
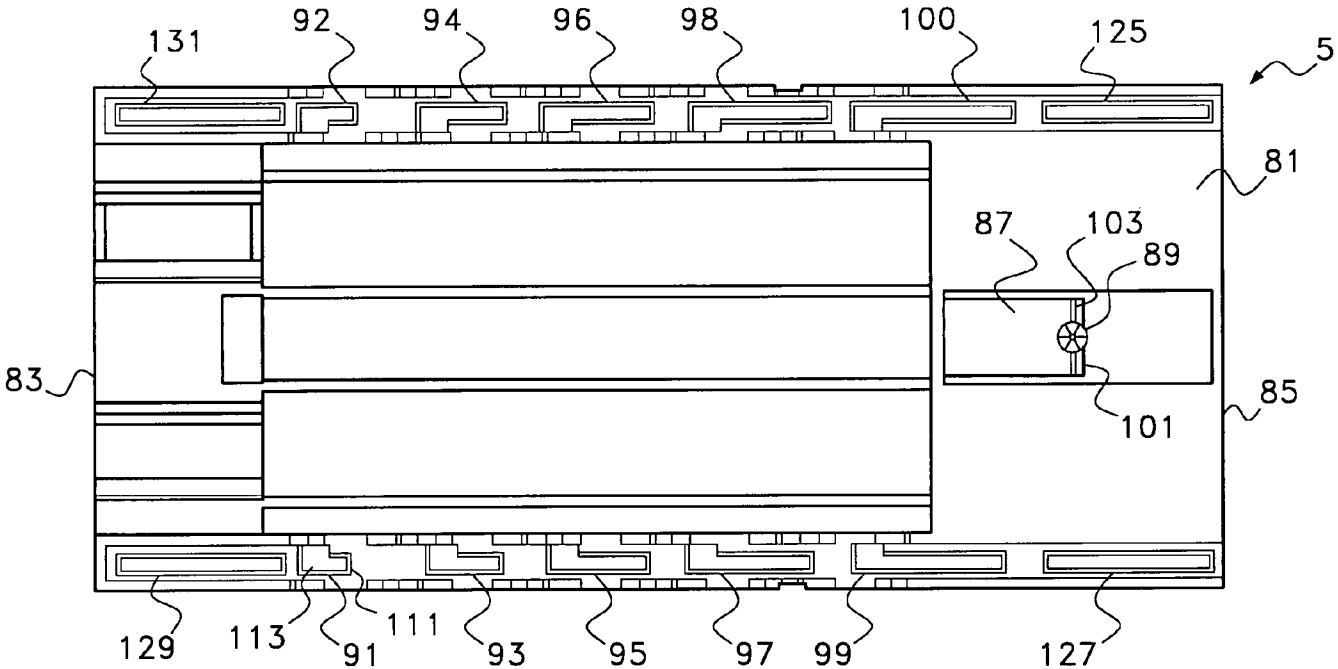
Figure 5:
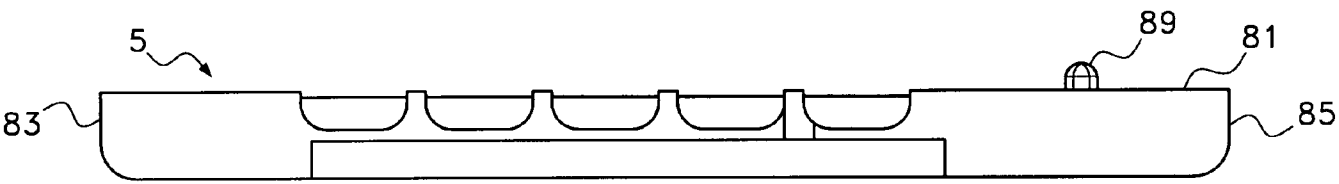

FIGS. 4, 5 and 6 will now be discussed simultaneously. These figures show top, side and back end views respectively of main housing bottom component 5, and identical parts are identically numbered.

Bottom component 5 includes a bottom panel 81, having a front 83 and a back 85. There are a plurality of slots shown as slots 91, 92, 93, 94, 95, 96, 97, 98, 99, and 100 that act as female lock elements for receiving the male lock element protrusions described above. Slots 91 through 100 respectively receive male lock element protrusions biased toward the back 85. Spring lock member 87 with push button 89 will nest with elongated orifice 23, and protrude through it. Ratchete edges 101 and 103 will nest with ratchetes 31 and 33 (or other ratchetes in front of them as usage progresses), to control movement of top component 3 relative to bottom component 5. In other words, when a user presses button 89, top element 3 may first be advanced so that protrusion 41 moves from position 111 to position 113, whereafter a user may lift up tab 11 and protrusion 41 will easily pass through the wider portion of slot 91 at position 113, so as to permit a user to easily lift up tab 11 to expose a first blister pack dosage. A user may then tear off a perforated or thinned section of a blister pack to remove a packaged dosage. Alternatively, a user may then remove the tablet from the blister pack in any fashion provided, to remove a unit dose, e.g. pushing a tablet through foil or peeling a foil.

With the first movement described above, none of the other protrusions will be in the wider sections of their respective slots. When button 89 is again pushed and top component 3 is further advanced forward, protrusion 42 will advance and will be in the wider slot area to permit tab 12 to be opened, but none of the other tabs will be positioned to be opened. There will be a sequence of advances that will permit each next tab, but no other tab, to be opened.

Note that with this sequence, the protrusion reaches its end point and thus stops further advancement, even if button 89 is depressed. Once that tab has been removed, the ratchetes will prevent advancement until button 89 is again depressed. In essence, in this embodiment, the protrusions act as stops and the ratchetes act as stops. To state it differently, both ratchete disengagement and protrusion removal are essential for a subsequent advance to occur.

Bottom component 5 also includes front 83. Above front 83 is an opening 57 for insertion of a blister pack (such as blister pack 100 shown in FIG. 9). Either the top component or the bottom component has a ramp that causes an inserted blister pack 100 to rest with its individual dosages in areas below the tabs when access is attained through the above movements. The ramp also acts as a stop to prevent or inhibit removal of a blister pack from child resistant multiple dosage blister pack dispenser of the present invention.

Note that slots 125, 127, 129, and 131 have no wide areas. Corner protrusions 135, 137, 139, and 141 fit into those slots to lock top component 3 into bottom component 5 and prevent subsequent separation. The top component is slideable but not removable from the bottom component. It is the other features described above that create the two step system to operate child resistant dispenser of the present invention.

Figure 7:
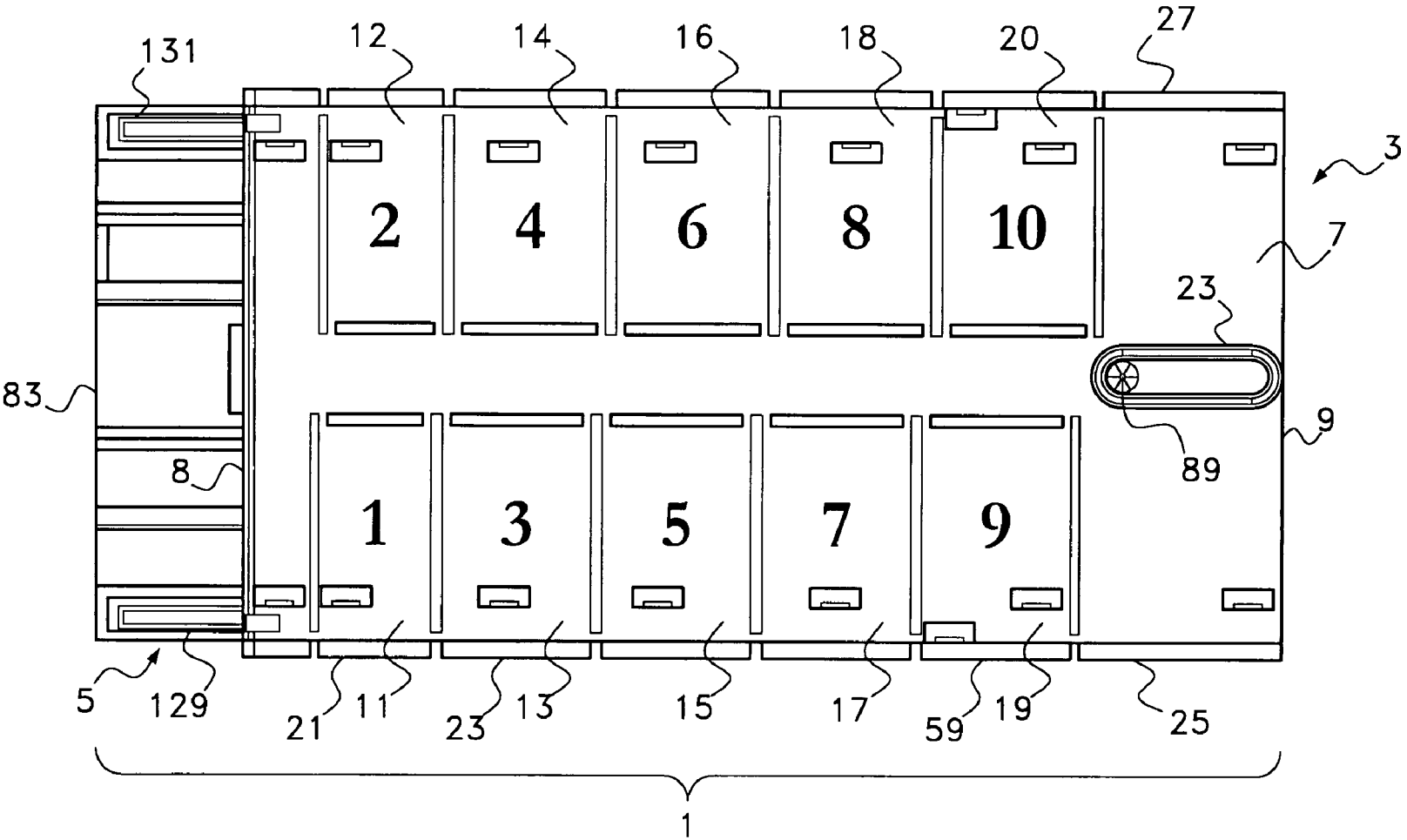
FIG. 7 illustrates a top view of the main housing top component and of the main housing bottom component of the present invention dispenser shown in FIGS. 1 through 6.

FIG. 7 shows a top view of present invention device 1, with all other components shown above and identically numbered.

Figure 8:
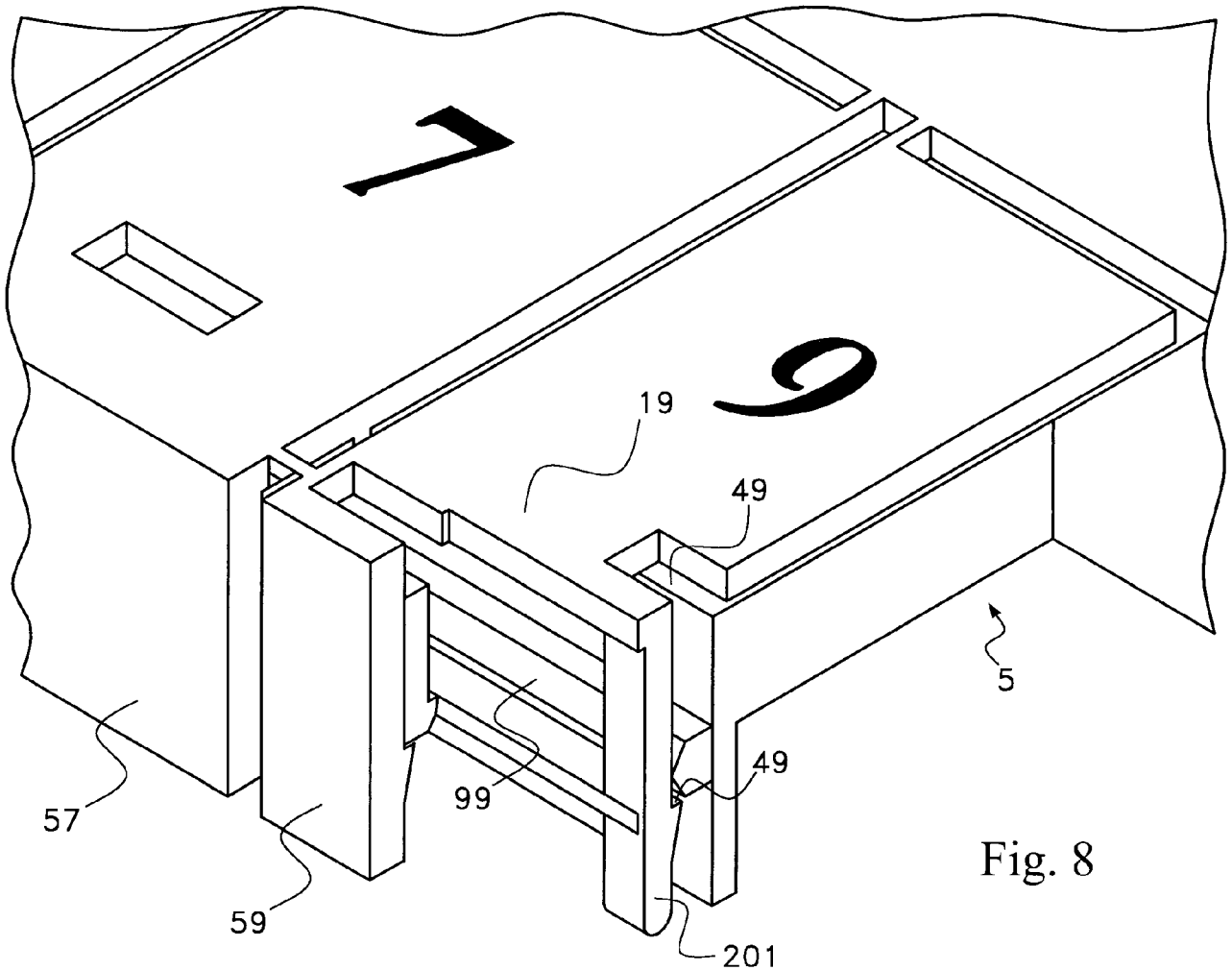
FIG. 8 illustrates an oblique top partial cut view of the device of FIG. 7; and, FIG. 9 shows a front end view of the present invention device shown in FIG. 8.

FIG. 8 shows an oblique end view of the corner area at tab 19 from the above Figures, to illustrate a preferred configuration of components. Identical parts for above are identically numbered. Male tab lock element 201 has male tab lock element protrusion 49 that locks under the ledge of slot 99, until moved to the wider end for opening. Of course, in the alternative, the male elements could be connected to the bottom component and project upwardly with the female lock elements being located in the top component, or they cold be mixed with some males and females in the top and concomitant females and males in the bottom, without exceeding the scope of the present invention.

Figure 9:
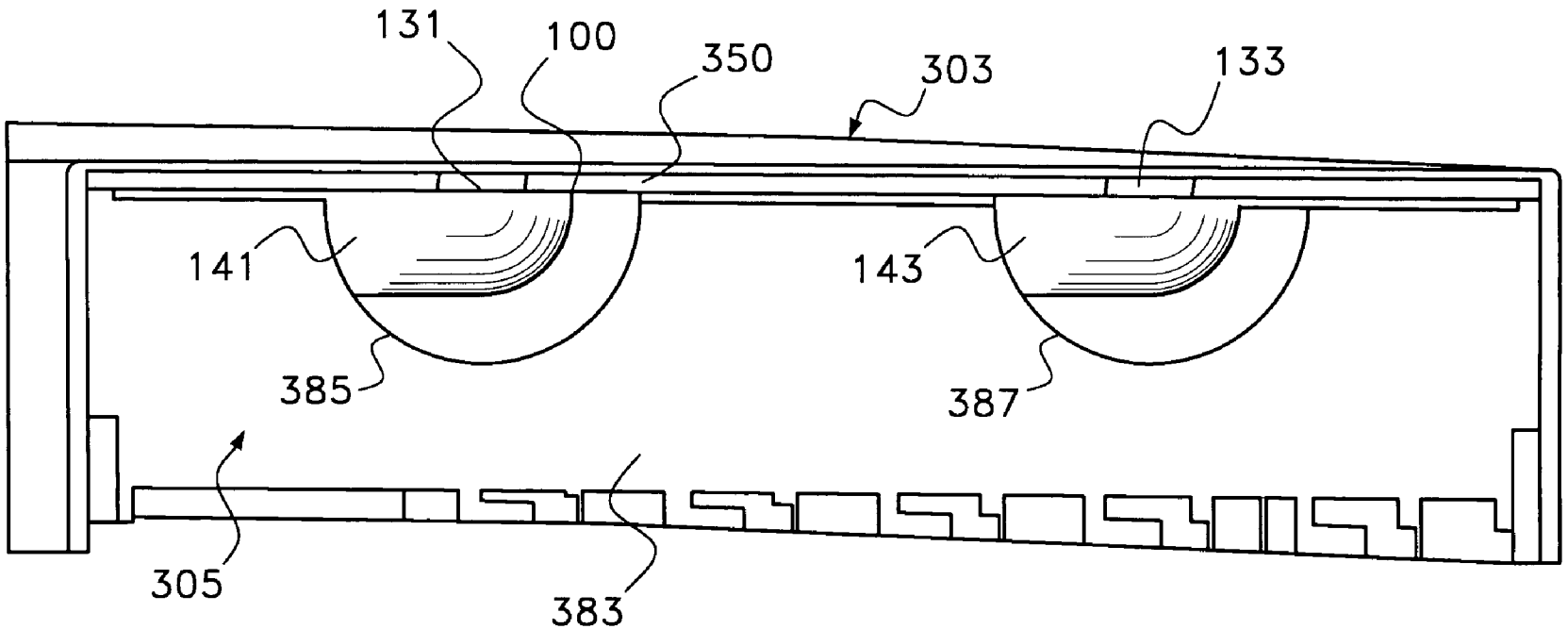

FIG. 9 shows an oblique front end view of dispenser 1, showing blister pack stops and blister pack 100, showing dosages 141 and 143. This shows how a bottom component 305 with a front 383, could have cut-outs 385 and 387 for insertion of blister pack 100. Top component 303 has a front 350 with blister pack stops 131 and 133 to permit insertion of a blister pack and then prevent its removal.

The foregoing illustrates the present invention concept, but for blister packs with two rows of medication. The present invention applies the above overall concept specifically to single row as well as multiple row blister packs by utilizing appropriately positioned rows of tabs. Even three or four row blister packs could be accommodated by having "flag lot" tabs, as needed. These tabs may be positioned, locked, unlocked, and advanced, in a step-wise fashion, to operate on a row-by-row basis, e.g. one row at a time, if desired.

The present invention device may be made of plastic, metal, cellulosic products or a combination thereof. Further, a blister pack insertion opening is used in embodiments wherein a blister pack may be inserted at some location or at same time after assemblage of the device itself. Alternatively, the device could have no insertion orifice to receive a blister pack, but would be assembled with the blister pack being inserted before the top component and bottom component are assembled together.

Obviously, numerous modifications and variations of the present invention are possible in light of the above teachings. It is therefore understood that within the scope of the appended claims, the invention may be practiced otherwise than as specifically described herein.

What is claimed is:

1. A child resistant multiple dosage blister pack dispenser for use with blister packs having at least one row of medication, which comprises:

(a.) a main housing bottom component having support means for supporting and securing at least one blister pack, said bottom component having a first spring lock member for interaction with a second spring lock member located on a top component, one of said first spring lock member and said second spring lock member having a first position, being a rest position, wherein it is in a top component locking position to prevent tablet dispensing sliding movement of said top component relative to said bottom component, and having a second position, being a stressed position, wherein it is in a top component unlocking position to permit sliding movement of said top component, said bottom component having an elongated configuration with an opening through which a blister pack may be inserted and secured, individual dosages of said blister pack being located within said bottom component in a predetermined pattern when said blister pack is inserted therein, said main housing bottom component having a plurality of ones of male and female tab lock elements, each of said plurality of ones of male and female lock elements forming lock sets, each lock set having a different opening position from all other lock sets;

(b.) said main housing top component, slideably and fixedly mounted on said main housing bottom component so as to be capable of forward movement relative to said bottom component when one of said first spring lock member and said second spring lock member is in said stressed position, and having a plurality of tabs located on said main housing top component, each of said plurality of tabs having one of a male and female lock element corresponding to one of said plurality of ones of said main housing bottom component, each of said plurality of tabs having pull-up capability, such that when one of said first and second spring lock members is in said stressed position and said top component has been moved forward relative to said main housing bottom component, a first tab may be opened and one dosage unit is exposed for removal, and sequentially thereafter when one of said first and second spring elements is pressed to its stress position and said top component is moved further forward, only one next tab may be opened for one next dosage unit exposure, and, the foregoing being sequentially repeatable until all dosage units have been exposed;

(c.) a plurality of stops located on at least one of said bottom component and said top component, said stops being sequentially arranged to correspond to sequential opening positions of said tabs, wherein each stop cannot be overcome until a prior tab has been opened, wherein a user may move one of said first spring lock member and said second spring lock member into its second position, push said top member to a first tab opening position, pull upon a tab, and remove a single unit dosage from said blister pack, and thereby position said top component for a repeat sequence to open a next tab.

2. The dispenser of claim 1 wherein said bottom component includes one of a track and a track rider and said top component includes walls having the other of said track and a track rider on said walls, and said track rider is located in said track so as that said track rider is slideable therein, and wherein said bottom component and said top component include at least one interconnection to restrict distance of relative movement between one another so as to not exceed a predetermined distance.

3. The dispenser of claim 1 wherein said bottom component has a corresponding number of diverse female lock elements corresponding to said male lock elements, and each of said tabs has a male lock element.

4. The dispenser of claim 3 wherein each of said female lock elements have at least one differing characteristic from all other female lock elements, said differing characteristic being selected from the groups consisting of a different position relative to its tab, and a different width from all other said female lock elements.

5. The dispenser of claim 1 wherein said stops are located on said tabs, and are selected from the group consisting of separate elements and male lock elements.

6. The dispenser of claim 1 wherein said main housing top component has at least two side walls, and a top panel wherein each of said tabs is connected to said top panel and extend into one of said side walls.

7. The dispenser of claim 5 wherein said main housing top component and bottom component are rectilinear.

8. The dispenser of claim 6 wherein one of said top component and said bottom component has locking means to prevent said top component from being moved backward relative to said bottom component after it has been moved forward.

9. The dispenser of claim 1 wherein each of said tabs has a thinned surround for rip away removal.

10. The dispenser of claim 8 wherein at least one of said top component and said bottom component includes a blister pack retainer stop to prevent removal of a blister pack therefrom.

11. A child resistant multiple dosage blister pack dispenser, which comprises:

(a) a main housing bottom component having support means for supporting and securing at least one blister pack, said bottom component having a first spring lock member for interaction with a second spring lock member located on a top component, one of said first spring lock member and said second spring lock member having a first position, being a rest position, wherein it is in a top component locking position to prevent tablet dispensing sliding movement of said top component relative to said bottom component, and having a second position, being a stressed position, wherein it is in a top component unlocking position to permit sliding movement of said top component, said bottom component having an elongated configuration with an opening through which a blister pack may be inserted and secured, individual dosages of said blister pack being located within said bottom component in a predetermined pattern when said blistered pack is inserted therein, said main housing bottom component having a plurality of ones of male and female tab lock elements, each of said plurality of ones of male and female lock elements forming lock sets, each lock set having a different opening position from all other lock sets;

(b) said main housing top component, slideably and fixedly mounted on said main housing bottom component so as to be capable of forward movement relative to said bottom component when one of said first spring lock member and said second spring lock member is in said stressed position, and having a plurality of tabs located on said main housing top component, each of said plurality of tabs having one of a male and female lock element corresponding to one of said plurality of ones of said main housing bottom component, each of said plurality of tabs having pull-up capability, such that when one of said first and second spring lock members is in said stressed position and said top component has been moved forward relative to said main housing bottom component, a first tab may be opened and one dosage unit is exposed for removal, and sequentially thereafter when one of said first and second spring elements is pressed to its stress position and said top component is moved further forward, only one next tab may be opened for one next dosage unit exposure, and, the foregoing being sequentially repeatable until all dosage units have been exposed;

(c) a plurality of stops located on at least one of said bottom component and said top component, said stops being sequentially arranged to correspond to sequential opening positions of said tabs, wherein each stop cannot be overcome until a prior tab has been opened, wherein a user may move one of said first spring lock member and said second spring lock member into its second position, push said top member to a first tab opening position, pull upon a tab, and remove a single unit dosage from said blister pack, and thereby position said top component for a repeat sequence to open a next tab;

(d) a blister pack located on said bottom component and under said top component, said blister pack having at least one row of individual dosages positioned and arranged so as to position a dosage under a corresponding tab, when one of said spring lock members is in its stressed position and said top component has been advanced forward.

12. The dispenser of claim 11 wherein said bottom component includes one of a track and a track rider on its walls and said top component includes walls having the other of said track and a track rider on said walls, and said track rider is located in said track so as that said track rider is slideable therein, and wherein said bottom component and said top component include at least one interconnection to restrict distance of relative movement between one another so as to not exceed a predetermined distance.

13. The dispenser of claim 11 wherein said bottom component has a corresponding number of diverse female lock elements corresponding to said male lock elements, and each of said tabs has a male lock element.

14. The dispenser of claim 13 wherein each of said female lock elements have at least one differing characteristic from all other female lock elements, said differing characteristic being selected from the group consisting of a different position relative to its tab, and a different width from all other said female lock elements.

15. The dispenser of claim 11 wherein said stops are located on said tabs, and are selected from the group consisting of separate elements and male lock elements.

16. The dispenser of claim 11 wherein said blister pack has two rows of individual dosages, and said main housing top component has at least two side walls, and a top panel with two rows of tabs, wherein each of said tabs is connected to said top panel and extend into a side wall.

17. The dispenser of claim 15 wherein said main housing top component and bottom component are rectilinear.

18. The dispenser of claim 16 wherein on of said top component and said bottom component has locking means to prevent said top component from being moved backward relative to said bottom component after it has been moved forward.

19. The dispenser of claim 11 wherein each of said tabs has a thinned surround for rip away removal.

20. The dispenser of claim 18 wherein at least one of said top component and said bottom component includes a blister pack retainer, stop to prevent removal of a blister pack therefrom.

* * * * *